US006096358A

United States Patent [19]

Murdick et al.

[11] Patent Number: 6,096,358

[45] **Date of Patent: *Aug. 1, 2000**

[54] METHOD OF MANUFACTURING AN ASEPTICALLY STERILIZED PACKAGE CONTAINING A LIQUID NUTRITIONAL PRODUCT

[75] Inventors: Brian K. Murdick, Columbus; Lewis H. Sita, Worthington; Todd A. Stevens, West Worthington; Vera T. Stavroff, New Albany, all of Ohio

[73] Assignee: Abbott Laboratories, Abbott Park, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/947,245

[22] Filed: Oct. 8, 1997

[51] Int. Cl.[7] ..... B65B 31/00

[52] U.S. Cl. ..... 426/399; 426/127; 426/410; 426/415; 215/232; 53/412; 53/453; 53/485

[58] Field of Search ..... 426/399, 127, 426/415, 410, 412; 359/220; 215/232; 229/125.35; 383/113; 53/453, 456, 485, 412

[56] References Cited

U.S. PATENT DOCUMENTS

| | | | |
|---|---|---|---|
| 4,564,121 | 1/1986 | Brochman | 220/359 |
| 4,778,698 | 10/1988 | Ou-Yang | 215/347 |
| 4,960,216 | 10/1990 | Giles et al. | 215/232 |
| 4,982,872 | 1/1991 | Avery | 220/461 |

OTHER PUBLICATIONS

The Wiley Encyclopedia of Packaging Technology (p. 21–23), (p273), (p. 669–685), 1986.

*Primary Examiner*—David Lacey
*Assistant Examiner*—Hao Mai
*Attorney, Agent, or Firm*—Brian R. Woodworth; Daniel J. Hulseberg

[57] ABSTRACT

Aseptically sterilized package of a liquid nutritional product manufactured by (a) providing a multi-layered plastic sheet having at least one polymeric structural layer and at least one polymeric barrier layer; (b) passing the sheet through a peroxide bath; (c) locating the sheet in a sterile environment; (d) applying heat a plurality of times to the sheet; (e) forming the sterilized sheet into a container having a body portion; (f) filling the body portion with a liquid nutritional product; (g) sealing the container with a tabbed, multi-layered closure; and (h) separating the sealed container from the remainder of the sheet. Preferably the liquid nutritional product is infant formula. In the preferred embodiment of the invention, the sheet is a laminate having two structural layers, each being about 45% of the laminate thickness and secured to either side of the barrier layer, which is about 5% of the laminate thickness, by an adhesive layer of about 2.5% of the laminate thickness. The container is prepared by thermoforming and deep drawing the multi-layered sheet. Pressure forming of the container is performed with the sheet temperature being 162° C. using a plug-assist and a pressure of about 5 BAR. Once filled, the container is sealed using a thermo sealing process.

20 Claims, 1 Drawing Sheet

FIG. 1
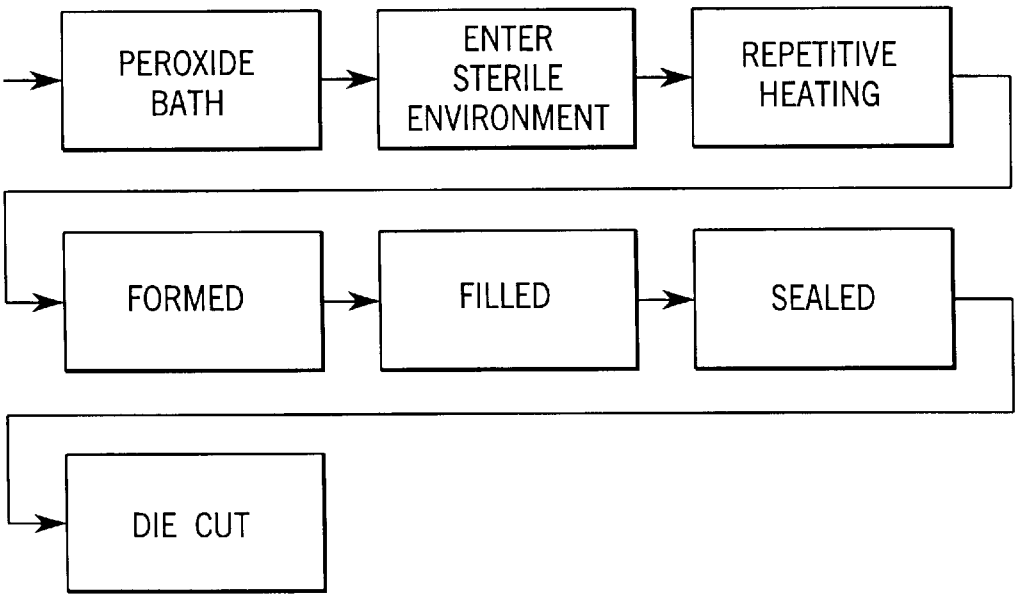
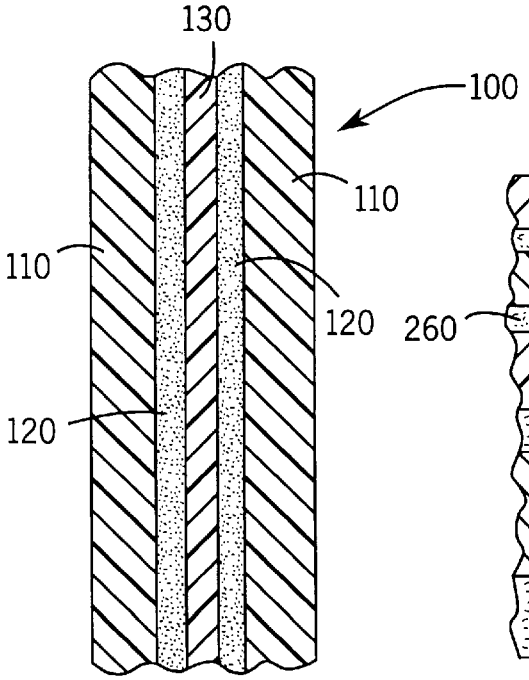
FIG. 2
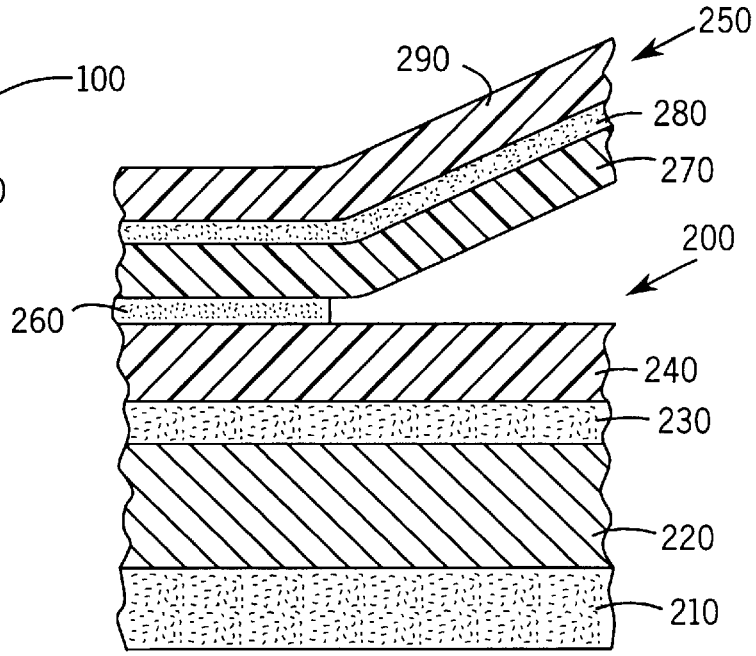
FIG. 3

METHOD OF MANUFACTURING AN ASEPTICALLY STERILIZED PACKAGE CONTAINING A LIQUID NUTRITIONAL PRODUCT

BACKGROUND OF THE INVENTION

The present invention relates generally to a sterilized package of liquid nutritional product, and more specifically to one which has been sterilized aseptically and which contains infant formula.

For years, packaging of food products for storage and distribution has been primarily conducted in glass or metal containers. The costs associated with these containers, their closures, and their labels have increased and are projected to continue to rise. Utilization of thermoplastic materials would conserve more energy on a packaging and distribution systems basis. Additionally, the costs would not be as great. Therefore, it is extremely desirable to provide food products packaged in thermoplastic materials.

In the area of liquid nutritional products, packaging of such products for ambient temperature storage and distribution have increasingly utilized thermoplastics. In general, there are two approaches to the packaging of food products in a container. The first method utilizes retorting, whereby a food is placed into a container, the container is sealed, and then the container and product are subjected to heat, such that the product is sterilized. In the second method, a container is subjected to a sterilizing process prior to its receiving sterilized food product. Conventional processes for sterilizing containers in which food stuff is subsequently packaged include UV irradiation, treatment with a mixture of steam and air, and an aseptic technique in which the interior wall of the container is sprayed with hydrogen peroxide and subsequently dried.

It can be appreciated that because of the heat sensitivity of many thermoplastics, conventional retort sterilization techniques can damage or destroy many thermoplastic packages of the type containing food product under ambient conditions for prolonged periods. On the other hand, application of aseptic packaging would permit increased usage of thermoplastic packaging materials, since application of aseptic techniques would leave the package unaltered and undamaged. Additionally, food products subjected to aseptic packaging involves minimal alteration of the food product by processing, thereby potentially yielding a higher-quality end product.

U.S. Pat. No. 4,742,667 discloses a method of an apparatus for aseptic packaging. The general components of the system shown in that particular patent are typical of the component in many aseptic sterilization systems. In operation, a food product package arrives at a sterilization station. Hydrogen peroxide or another suitable disinfectant is applied to the inner surface of the container. Often times, the application involves atomization of a liquid so that a mist is applied. After application of the disinfectant, the container is transported along a conveyor, during which transport the food product container is subjected to additional sprayings of hot air.

Although disposable feeding packages for liquid nutritional products, especially infant formula and sterile water for infants, are desirable, heretofore such containers have only utilized the retort sterilization technique. The desirability of such a product cannot be underestimated since it can be used in a nursing system so as to eliminate the need for sterilizing bottles and other time-consuming tasks related to the feeding of infants. Such a package would be extremely desirable when an infant is away from home, for example at a day care center or during travel.

Examples of plastic containers that have been employed in the area of retortable packages are disclosed in published PCT application WO 90/14066. However, that particular reference neither teaches a method of manufacturing for use in retort conditions and is devoid of any disclosure or suggestion as to how, or even if, that particular disposable pre-sterilized feeding package may be used in an aseptic sterilization system. With respect to the closure for the top of the container, a number of closures are disclosed in U.S. Pat. No. 5,004,111, although the discussion of that particular closure omits any discussion of potential use in aseptic situations.

It is thus apparent that the need exists for an aseptically sterilized package of liquid nutritional product, specifically infant formula.

SUMMARY OF THE INVENTION

In accordance with this invention, there is disclosed an aseptically sterilized package of a liquid nutritional product manufactured by the process of: (a) passing a multi-layered plastic sheet through a peroxide bath, with this sheet having at least one polymeric structural layer and at least one polymeric barrier layer; (b) causing the sheet to enter a sterile environment; (c) applying heat a plurality of times to the sheet; (d) providing a plastic container by forming a collapsible body portion; (e) filling the body portion with a liquid nutritional product; (f) sealing the container with a tabbed, multi-layered closure; and (g) separating the sealed container from the sheet.

Preferably the liquid nutritional product is an infant formula. Furthermore, preferably the container has a multi-layer structure of a barrier layer of ethylene vinyl alcohol copolymer disposed between two structural layers of polypropylene, with adhesive layers adhering the structural layers to the barrier layer. More preferably, the container is formed from a laminate wherein each of the structural layers is about 45% of the thickness of the laminate, the barrier layer is about 5% of the thickness of the laminate, and each of the adhesive layers is about 2.5% of the thickness of the laminate.

Additionally, preferably the closure is fabricated from a film comprising at least one material selected from a group of materials consisting of plastics and metals. In the preferred embodiment of the invention the closure has a multi-layer structure comprising a laminate wherein the laminate comprises layers of a heat seal coating, a metal foil, an adhesive, and glycol modified polyethylene terephthalate, with the heat seal coating directly adjacent the metal foil, the metal foil also directly adjacent the adhesive, the adhesive also directly adjacent the glycol modified polyethylene terephthalate. More preferably, the aseptically sterilized package has a multi-layer structure comprising a laminate and a tab, with the tab comprising layers of glycol modified polyethylene terephthalate and polyethylene, or layers of glycol modified polyethylene terephthalate and a metal foil, and with the tab secured to the laminate by an adhesive laminate.

In the preferred embodiment of the invention, heat is applied eight times to the plastic sheet. Further, the heat is applied to the aseptically sterilized package applied by means of a stream of hot air. Furthermore, forming of the aseptically sterilized package occurs through the use of a plug coupled with pressure on the surface of the sheet which becomes the interior of the container. Finally, the sealed container is separated from the sheet by means of die cutting.

There is also disclosed an aseptically sterilized package of a liquid nutritional product manufactured by the process of: (a) passing a multi-layered plastic sheet through a peroxide bath, with the sheet having at least one polymeric structural layer and at least one polymeric barrier layer; (b) causing this sheet to enter a sterile environment; (c) applying heat a plurality of times to the sheet, with the heat being applied fight times to the plastic sheet by means of a stream of hot air; (d) providing a plastic container by forming a collapsible body portion, with the container having a multi-layer structure of a barrier layer of ethylene vinyl alcohol copolymer disposed between two structural layers of polypropylene, with adhesive layers adhering the structural layers to the barrier layer, and wits the container being for-med from a laminate wherein each of the structural layers is about 45% of the thickness of the laminate, the barrier layer is about 5% of the thickness of the laminate, and each of the adhesive layers is about 2.5% of the thickness of the laminate, with the forming occurring through the use of a plug coupled with pressure on the surface of the sheet which becomes the interior of the container; (e) filling the body portion with a liquid nutritional product; (f) sealing the container with a tabbed, multi-layered closure, with the closure fabricated from a film comprising at least one material selected from a group of materials consisting of plastics and metals, and with the closure having a multi-layer structure comprising a laminate and a tab, and with the closure having a multi-layer structure comprising a laminate wherein the laminate comprises layers of a heat seal coating, a metal foil, an adhesive, and glycol modified polyethylene terephthalate, with the heat seal coating directly adjacent the metal foil, the metal foil also directly adjacent the adhesive, the adhesive also directly adjacent the glycol modified polyethylene terephthalate, with the tab comprising layers of glycol modified polyethylene terephthalate and polyethylene, or layers of glycol modified polyethylene terephthalate and a metal foil, with the tab secured to the laminate by an adhesive laminate, and (g) separating the sealed container from the sheet by means of die cutting.

The primary objective of this invention is to provide an aseptically sterilized package of a liquid nutritional product. Important aspects of this invention are that both the walls and the closure present barriers forming an effective seal.

These and other objects and advantages of this invention will be readily apparent from the following detailed description of the invention. Reference will be had to the accompanying drawings which illustrate the embodiment of the s invention.

DESCRIPTION OF THE DRAWING FIGURES

FIG. 1 discloses a schematic of the process of manufacture of the invention.

FIG. 2 discloses a fragmentary, vertical cross-sectional view on a greatly enlarged scale of the container wall associated with the preferred embodiment of the invention.

FIG. 3 discloses a fragmentary, horizontal cross-sectional view on a greatly enlarged scale of the tabbed closure associated with the preferred embodiment of the invention.

DESCRIPTION OF THE ILLUSTRATIVE EMBODIMENT

Having reference to the drawings, attention is directed first to FIG. 1 which illustrates a schematic of the process for manufacture of an aseptically sterilized liquid nutritional product made in accordance with this invention. A multi-layered plastic sheet enters the sterile environment where the liquid nutritional is to be introduced into the container in which it is to be ultimately packaged. However, just prior to entering this sterile environment, the plastic sheet from which the container for the liquid nutritional will ultimately be formed, is caused to pass through a peroxide bath, thereby sterilizing the entire plastic sheet, as both sides of the sheet are brought into contact with a peroxide solution typical of peroxide solutions already in use with aseptic packaging technique.

Once the multi-layered plastic sheet has passed through the peroxide bath, it then enters into a sterile environment. Upon entering this environment, the upper surface of the plastic sheet undergoes repetitive heating by the blowing thereon of heated air. In the preferred embodiment of this invention, it has been discovered that there are a plurality of heatings, with that number more preferably having been determined as being eight. Additionally, the air coming into contact with the plastic sheet is heated to a temperature of 100°.

Preferably the multi-layered plastic sheet includes at least one polymeric structural layer and at least one polymeric barrier layer. The preferred embodiment for the multi-layered plastic sheet associated with this invention can be best appreciated in FIG. 2. The sheet 100 which ultimately is formed into the walls of a container comprise two structural layers 110 of polypropylene. Preferably adjacent to each of the structural layers is an adhesive layer 120 which assists in securing of the structural layer to a barrier layer 130. The barrier layer associated with this invention preferably comprises ethylene vinyl alcohol (EVOH). Such polymers can be prepared by well known processes of copolymerization of ethylene and vinyl alcohol, followed by saponification. The multi-layered sheet may be prepared by coextrusion or lamination, although the lamination process is to be preferred.

Preferably the closure is fabricated from a film comprising at least one material from selected from a group of materials consisting of plastics and metals. In the preferred embodiment of the invention, the closure has a multi-layer structure comprising a laminate wherein the laminate comprises layers of a heat sealing coating (HSC), a metal foil, an adhesive, and glycol modified polyethylene terephthalate (PETG). Preferably the heat seal coating is MORPRIME®, a material having a polypropylene base and forming a semi-compatible bond with the polypropylene container. Other possible heat seal coatings could include ethylene-vinyl acetate (EVA) and ethylene-acrylic acid (EAA).

The use of this particular heat seal coating associated with this invention forms a cohesive bond between the container and the closure, as opposed to an adhesive bond. The resultant closure exhibits up to 2 pounds of resistance during the removal process. Preferably the heat seal coating is directly adjacent the metal foil, with the metal foil also being directly adjacent the adhesive. The adhesive is preferably directly adjacent the PETG. Directly above the aforementioned layer of PETG is a tab structure. The tab comprises layer of PETG or polyethylene, or layers of PETG and a metal foil, preferably aluminum with the tab being secured to the closure laminate by an adhesive laminate.

To best appreciate the closure, attention is directed to FIG. 3 showing the closure 200 and the respective layers of a heat seal coating 210, a metal foil, preferably aluminum, 220, an adhesive laminate 230, PETG 240, and the tab 250 with the tab comprising an adhesive laminate 260, PETG 270, an adhesive 280 and either polyethylene or a metal foil 290.

Once the container is filled and sealed, it then exits the sterile zone where the individual packages are removed from contact with the multi-layer sheet by means of die cutting.

In the finished package, the tab portion is preferably formed so as to extend substantially across the width of the body portion of the container and approximately one-half of the way across the diameter.

While the form of apparatus herein described constitutes a preferred embodiment of the invention, it is to be understood that the invention is not limited to this precise form of apparatus, and that changes may be made therein without departing from the scope of the invention, which is defined in the appended claims.

We claim:

1. A method of manufacturing an aseptically sterilized package of a liquid nutritional product, the method comprising the steps of:

(a) providing a multi-layered plastic sheet having at least one polymeric structural layer and at least one polymeric barrier layer;

(b) passing the sheet through a peroxide bath;

(c) locating said sheet in a sterile environment;

(d) applying heat a plurality of times to said sheet;

(e) forming said sheet into a container having a body portion;

(f) filling said body portion with a liquid nutritional product;

(g) sealing the container with a multi-layered closure having a tab to define a sealed container; and (h) separating the sealed container from a remainder of said sheet.

2. The method according to claim 1 wherein the liquid nutritional product filled into the body portion by the filling step is an infant formula.

3. The method according to claim 1 wherein said closure sealed to the container by the sealing step is fabricated from a film including at least one material selected from a group of materials consisting of plastics and metals.

4. The method according to claim 1 wherein the sheet provided by the providing step includes two polymeric structural layers, each of polypropylene, and the polymeric barrier layer is an ethylene vinyl alcohol copolymer disposed between the two structural layers of polypropylene, with adhesive layers adhering the structural layers to the barrier layer.

5. The method according to claim 4 wherein said sheet provided by the providing step is a laminate and further wherein each of the structural layers is about 45% of the thickness of the laminate, the barrier layer is about 5% of the thickness of the laminate, and each of the adhesive layers is about 2.5% of the thickness of the laminate.

6. The method according to claim 1 wherein said closure sealed to the container by the sealing step is a laminate, said laminate including layers of a heat seal coating, a metal foil, an adhesive, and glycol modified polyethylene terephthalate, said heat seal coating directly adjacent said metal foil, said metal foil also directly adjacent said adhesive, and said adhesive also directly adjacent said glycol modified polyethylene terephthalate.

7. The method according to claim 6 wherein the tab of said closure sealed to the container by the sealing step is secured to the laminate by an adhesive, said tab including layers of glycol modified polyethylene terephthalate and polyethylene.

8. The method according to claim 1 wherein said heat of the applying step is applied eight times to said sheet.

9. The method according to claim 1 wherein said heat of the applying step is applied by a stream of hot air.

10. The method according to claim 1 wherein said forming step includes using a plug coupled with pressure on a surface of the sheet to define a interior of said container.

11. The method according to claim 1 wherein said sealed container is separated by the separating step from the remainder of said sheet using a die cutting process.

12. The method according to claim 2 wherein said closure sealed to the container by the sealing step is fabricated from a film including at least one material selected from a group of materials consisting of plastics and metals.

13. The method according to claim 2 wherein the sheet provided by the providing step includes two polymeric structural layers, each of polypropylene, and the polymeric barrier layer is an ethylene vinyl alcohol copolymer disposed between the two structural layers of polypropylene, with adhesive layers adhering the structural layers to the barrier layer.

14. The method according to claim 13 wherein said sheet provided by the providing step is a laminate and further wherein each of the structural layers is about 45% of the thickness of the laminate, the barrier layer is about 5% of the thickness of the laminate, and each of the adhesive layers is about 2.5% of the thickness of the laminate.

15. The method according to claim 2 wherein said closure sealed to the container by the sealing step is a laminate, said laminate including layers of a heat seal coating, a metal foil, an adhesive, and glycol modified polyethylene terephthalate, said heat seal coating directly adjacent said metal foil, said metal foil also directly adjacent said adhesive, and said adhesive also directly adjacent said glycol modified polyethylene terephthalate.

16. The method according to claim 15 wherein said closure sealed to the container by the sealing step includes a tab secured to the laminate by an adhesive, said tab including layers of glycol modified polyethylene terephthalate and polyethylene.

17. The method according to claim 2 wherein said heat of the applying step is applied by a stream of hot air directed eight times to said plastic sheet.

18. The method according to claim 6 wherein the tab of said closure sealed to the container by the sealing step is secured to the laminate by an adhesive, said tab including layers of glycol modified polyethylene terephthalate and a metal foil.

19. The method according to claim 15 wherein the tab of said closure sealed to the container by the sealing step is secured to the laminate by an adhesive, said tab including layers of glycol modified polyethylene terephthalate and a metal foil.

20. A method of manufacturing an aseptically sterilized package of a liquid nutritional product, the method comprising the steps of:

(a) providing a multi-layered plastic sheet having at least one polymeric structural layer and at least one polymeric barrier layer including a barrier layer of ethylene vinyl alcohol copolymer disposed between two structural layers of polypropylene, the structural layers being adhered to the barrier layer by adhesive layers to define a laminate having a thickness, wherein each of the structural layers is about 45% of the thickness of the laminate, the barrier layer is about 5% of the thickness of the laminate, and each of the adhesive layers is about 2.5% of the thickness of the laminate;

(b) passing the sheet through a peroxide bath;

(c) locating said sheet in a sterile environment;

(d) applying heat a plurality of times to said sheet, said heat being applied eight times to said sheet by a stream of hot air;

(e) forming said sheet into a container having a body portion using a plug coupled with pressure on a surface of the sheet to define an interior of said container;

(f) filling said body portion with a liquid nutritional product;

(g) sealing the container with a multi-layered closure having a tab to define a sealed container, said closure fabricated from a laminate including layers of a heat seal coating, a metal foil, an adhesive, and glycol modified polyethylene terephthalate, said heat seal coating directly adjacent said metal foil, said metal foil also directly adjacent said adhesive, and said adhesive also directly adjacent said glycol modified polyethylene terephthalate, and further wherein said tab is secured to the laminate by an adhesive, the tab including layers of glycol modified polyethylene terephthalate and polyethylene, or layers of glycol modified polyethylene terephthalate and a metal foil; and (h) separating the sealed container from a remainder of said sheet by a die cutting process.

* * * * *

UNITED STATES PATENT AND TRADEMARK OFFICE

CERTIFICATE OF CORRECTION

PATENT NO. : 6,096,358
DATED : August 1, 2000
INVENTOR(S) : Brian K. Murdick et al.

It is certified that error appears in the above-identified patent and that said Letters Patent is hereby corrected as shown below:

Column 3,
Line 8, replace "fight times to the plastic" with -- eight times to the plastic --.
Line 14, replace "layer, and wits the container being for-med" with -- layer, and with the container being formed --.

Signed and Sealed this

Sixteenth Day of April, 2002

*Attest:*

*Attesting Officer*

JAMES E. ROGAN
*Director of the United States Patent and Trademark Office*